US007127970B2

(12) United States Patent
Kirchgaessler

(10) Patent No.: US 7,127,970 B2
(45) Date of Patent: Oct. 31, 2006

(54) TOOL FOR TIGHTENING AND LOOSENING A WING NUT OR WING SCREW THAT SECURES A MOTOR VEHICLE WHEEL

(76) Inventor: Michael Kirchgaessler, Im Winkel 24, 31199 Diekholzen (DE)

( * ) Notice: Subject to any disclaimer, the term of this patent is extended or adjusted under 35 U.S.C. 154(b) by 0 days.

(21) Appl. No.: 11/188,416

(22) Filed: Jul. 25, 2005

(65) Prior Publication Data

US 2006/0162506 A1 Jul. 27, 2006

(30) Foreign Application Priority Data

Jan. 25, 2005 (DE) ..... 20 2005 001 232 U

(51) Int. Cl.
*B25B 13/00* (2006.01)
*B25B 13/06* (2006.01)

(52) U.S. Cl. ..... 81/124.2; 81/120; 81/121.1; 81/125

(58) Field of Classification Search ..... 81/124.2, 81/120, 121.1, 125
See application file for complete search history.

(56) References Cited

U.S. PATENT DOCUMENTS 3,151,512 A 10/1964 Charczenko
5,697,268 A * 12/1997 Makovsky et al. ..... 81/125
5,698,268 A 12/1997 Takagi et al.
6,294,719 B1 * 9/2001 Palecki et al. ..... 84/458
6,314,841 B1 * 11/2001 Burk et al. ..... 81/125.1
6,715,384 B1 * 4/2004 Kozak ..... 81/124.2

FOREIGN PATENT DOCUMENTS

| | | |
|---|---|---|
| DE | 87 01 555 U1 | 4/1987 |
| DE | 88 14 967 U1 | 5/1989 |
| DE | 93 18 159 U1 | 1/1994 |
| DE | 295 19 672 U1 | 2/1996 |
| DE | 200 02 763 U1 | 6/2000 |
| GB | 113540 | 2/1918 |

* cited by examiner

*Primary Examiner*—Lee D. Wilson
*Assistant Examiner*—Shantese McDonald
(74) *Attorney, Agent, or Firm*—Darby & Darby

(57) ABSTRACT

A tool for tightening and loosening a wing nut having several wings that secures a motor vehicle wheel includes has a base element with three detachably attached contact bodies for the individual wings. The bodies serve to transfer the torque needed for tightening and loosening the wing nuts. The end of each contact body facing the wheel is provided with a projection that, for purposes of avoiding axial slippage of the tool off the wing nut in the functional position shown in FIGS. 2 and 3, engages behind a wing. The projection in question is dimensioned in such a manner that a slot located between adjacent projections is only slightly larger than the corresponding wing. Each of the contact bodies, which are configured as cleats, has a contact surface that can be placed against the wing during either tightening or loosening. In order to apply the torque, the base element has a receptacle configured as a square opening to receive a commercially available torque tool.

16 Claims, 5 Drawing Sheets

TOOL FOR TIGHTENING AND LOOSENING A WING NUT OR WING SCREW THAT SECURES A MOTOR VEHICLE WHEEL

Priority is claimed to German Patent Application No. DE 20 2005 001 232.7, filed on Jan. 25, 2005, the entire disclosure of which is incorporated by reference herein.

The present invention relates to a tool for tightening and loosening a central wing nut or wing screw having several wings that secures a wheel of a motor vehicle, said tool having a base element with at least two contact bodies separated by slots, each for one wing, for transferring the torque from the tool to the wing nut or wing screw.

BACKGROUND

Such a tool is employed in actual practice for tightening or loosening the wing nuts of a central wheel lock, particularly of classical automobiles. For this purpose, special wooden tools for wing nuts are known that allow an approximately positive fit of the wing nut that secures the wheel of a motor vehicle. Here, the wooden wrench is configured as a wooden board having a slot that matches the contour of the wing nuts.

A drawback of such a wooden tool is the lack of protection against axial slippage. Here, it has also proven to be problematic that, in the case of a central wheel lock for motor vehicles, especially for wheels with spokes, the wings do not lie in a plane parallel to the axis of rotation, but rather, they essentially exhibit a slight pitch with respect to the plane that is crosswise with respect to the axis of rotation. This results in essentially undefined contact surfaces whose inclination further promotes the tendency towards slippage. Moreover, such wooden wrenches can only transfer low torques, in addition to which their magnitude cannot be reliably reproduced.

Therefore, such wing nuts for central wheel locks are loosened and tightened with a copper hammer even nowadays, so that it is essentially a matter of the skill of the mechanic to ensure that sufficient torque is applied. Moreover, in the long run, the stress caused on the wing nuts by such blows with a hammer results in visible and thus undesired damage to the surface.

Likewise known are various hand-held tools designed for tightening and loosening different types of wing nuts and the like for various application purposes.

For example, U.S. Pat. No. 5,697,268 relates to such a tool whose base element is followed by a shank that is configured as a hollow body and that has slit-like slots of different widths that are arranged in pairs across from each other so that all kinds of wing nuts can be reliably tightened or loosened. Here, the slots also form the contact bodies for each wing. A section of the base element located across from the shank serves to receive a commercially available wrench.

A tool known from German utility model G 93 18 159 U1 likewise has a shank that has connection means for transferring the torque, for instance, a bore for a lever or a plug-in connector for a universal tool, and whose other end is configured as an open pipe having two slit-shaped slots located across from each other and open towards the end of the tool that are designed to receive the wings of the wing nut or wing screw.

A tool configured as a socket wrench for tightening and loosening a wing nut is also described in German utility model G 87 01 555 U1, two elongated slots being located in a cylindrical socket wrench made of metal or a metal-like material, and the dimensions of said slots corresponding to the thickness of one wing of the wing nut. The cylindrical socket wrench is coated with plastic.

German utility model G 88 14 967 likewise discloses a wrench for wing nuts or castellated nuts of screw jacks used in concrete construction. For this purpose, the wrench has a sleeve with at least one pair of cams on its jacket, said cams projecting over the free front surface of the sleeve and interacting with the edges of the wings of the wing nut.

Furthermore, German utility model DE 200 02 763 U1 describes a socket wrench for mounting and dismounting a wing nut used for toilet seat brackets. For this purpose, the socket wrench is configured essentially hollow and has two grooves offset by 180° which serve to receive the wings of the wing nut. In order to transmit force, a sunk rectangular hollow body that serves to receive a ratchet can be used in addition to a metal pin.

Moreover, German utility model DE 295 19 672 U1 relates to a wrench for screwing and unscrewing wing nuts or hex nuts of the type employed for locking utility and electricity meters of power supply companies in a secure manner with a lead seal.

SUMMARY OF THE INVENTION

A drawback of the tools known from the state of the art and used for tightening and loosening a wing nut or wing screw is that they are not very well-suited for transferring relatively large torques. In particular, the contact surface of tools used for wing nuts, which is considerably smaller than the contact surface of tools used for conventional hex nuts, proves to be disadvantageous because the occurrence of a tilting moment that leads to axial slippage cannot be reliably ruled out.

Such tools are unsuitable for mounting wing nuts used as the central wheel lock in motor vehicle wheel rims, particularly in old-timers, since the slant of the wings promotes the slippage of the tool. Owing to the large torques, it is likewise not possible for a mechanic to manually press down the tool in order to avoid such slippage.

An object of the present invention is to provide a tool for tightening and loosening a wing nut or wing screw that secures a motor vehicle wheel by means of which tool a torque that can be predefined with reproducible precision can be reliably transferred. In particular, such a tool should reliably avoid axial slippage so that its handling is unproblematic, even for laypersons.

Thus, the present invention provides a tool for tightening and loosening a wing nut or wing screw that secures a motor vehicle wheel, said tool having a projection configured so as to engage behind especially at least one of the wings in the functional position of the tool in order to prevent the tool from axially slipping off the wing nut or wing screw. In this context, the invention is based on the knowledge that axial slippage of the tool can be reliably prevented if the tool has a projection that brings about an automatic locking of the tool in the axial direction through an undercut when the relative rotational movement of the tool is exerted vis-à-vis the wheel. The axial slippage is ruled out because, in order for this to happen, it would first be necessary to reverse the rotational direction. Moreover, due to the configuration according to the invention, the tool can easily be placed onto the wing nut or wing screw and then turned in the axially secured position, so that subsequently, the desired torque is applied by means of a lever arm equipped, for example, with means for determining the magnitude of the torque applied. Here, the lever arm can be of a length that is adapted to the torque and it can be actuated with two hands since there is no need for manually pressing down the tool.

An especially advantageous embodiment of the present invention is achieved in that the projection in question frees a slot that, in particular, is dimensioned slightly larger than the corresponding wing, whereby a relative change of the angular position—which is limited by the contact bodies—between the wing nut or wing screw and the tool simultaneously leads to a locking of the wings in the slot. Since the slot is coordinated with the dimensions of the wing, improper handling of the tool is reliably ruled out. In particular, this prevents the use of the tool for wing nuts that are not suitable for the tool. Moreover, even a slight change in the angular position relative to the placement position already causes a reliable locking which, in addition, can easily be undertaken by hand. Hence, the tool can first be positioned irrespective of the lever arm needed for applying the torque and the lever arm can subsequently be positioned during another work step in order to facilitate the handling.

Furthermore, it has proven to be especially advantageous for the projection that engages behind the wings in the functional position to be configured as a bayonet coupling, as a result of which any axial mobility of the tool relative to the wings is reliably prevented. Thus, in particular, in addition to positive locking, the bayonet coupling also allows a non-positive axial pre-tensioning of the tool against the wing nut or wing screw.

The tool could have various contact bodies for tightening and loosening the wing nut or wing screws, which are configured so as to match the generally asymmetric shape of the wings. However, a variant of the present invention that is particularly suitable in actual practice is one in which the contact body has a contact surface that can be placed against the wings when the wing nut or wing screw is being tightened on the one hand or is being loosened on the other hand. As a result, the tool can be used alternatively for loosening or tightening the wing nut or wing screw without changing the position of the tool, so that handling errors are virtually ruled out. Moreover, a considerably simpler design can be achieved which also entails low manufacturing costs and, at the same time, allows the use of the tool for different wing nuts or wing screws.

Here, it has proven to be particularly simple if the contact body is configured symmetrically, especially rotation-symmetrically, with respect to an axis that runs parallel to the thread axis of the wing nut or wing screw, since this simplifies the shaping process and allows the use of prefabricated contact bodies that fit onto different tools.

In this context, the tool is advantageously configured in such a way that, when the wings are loosened or tightened, they can be placed against the adjacent contact body in question, so that each contact body engages effectively with the wing nut or wing screw during tightening as well as loosening.

If wear and tear occurs, the contact bodies could be replaced according to another advantageous modification.

Moreover, this possibility of replacement, especially in conjunction with a variant in which the contact bodies can be affixed onto the base element in different positions, makes it possible to adapt the tool to different wing nuts or wing screws, thus allowing a universal deployment of the tool. For this purpose, the base element can have, for example, several internal threads that can also be provided with markings or lettering indicating the application purpose.

In order to prevent damage to the wing nut or wing screw—which cannot be ruled out according to the state of the art—in another modification that is likewise particularly suitable for actual practice, the contact bodies have aluminum, copper or plastic as their essential material constituents since these relatively soft materials also allow, for instance, plastic deformation while, at the same time, increasing the contact surface.

Another likewise especially useful modification of the present invention is achieved in that the base element has one or more placement elements for axially stabilizing the wings, thereby preventing the occurrence of a tilting moment brought about by the applied torque.

A lever for applying the torque could be realized as an integral part of the tool. However, a particularly advantageous refinement of the present invention is one in which the base element has a receptacle, especially configured in the form of a polygonal opening, to receive a commercially available torque tool. As a result, when the tool is used, a tool that is always available on board anyway can be employed to exert force, whereby the receptacle can also be configured so as to allow the alternative use of different tools having different functional sections.

Furthermore, it has been found to be particularly helpful if, in order to stabilize the wing nut or the wing screw having precisely two wings, the tool has a pivoting guide to receive these wings. This guide serves to reliably position the tool, whereby the guide is not configured or meant to transfer the torque. In particular, this reliably prevents lateral shifting of the tool crosswise to the axial direction of the wing nut or of the wing screw.

Moreover, it is particularly conducive to the objective when, in order to avoid damage to the wing nut or wing screw, the base element has, at least in sections, a plastic surface, especially a foam plate, that can also be configured with replaceable wearing strips, so that the tool can be reliably deployed, even for frequent use in workshops.

The invention is not limited to the above-mentioned embodiments. For instance, the desired locking can also be achieved by a blocking element such as, for example, a self-locking pawl, that can be affixed in different positions, and that reliably holds the tool in position, the wing nut or wing screw then being released through an additional manual intervention.

BRIEF DESCRIPTION OF THE DRAWINGS

The invention allows various embodiments. For purposes of further illustrating its basic principle, one of the embodiments is shown in the drawing and will be described below. The drawing shows the following in a schematic depiction.

DETAILED DESCRIPTION

Figure 1:
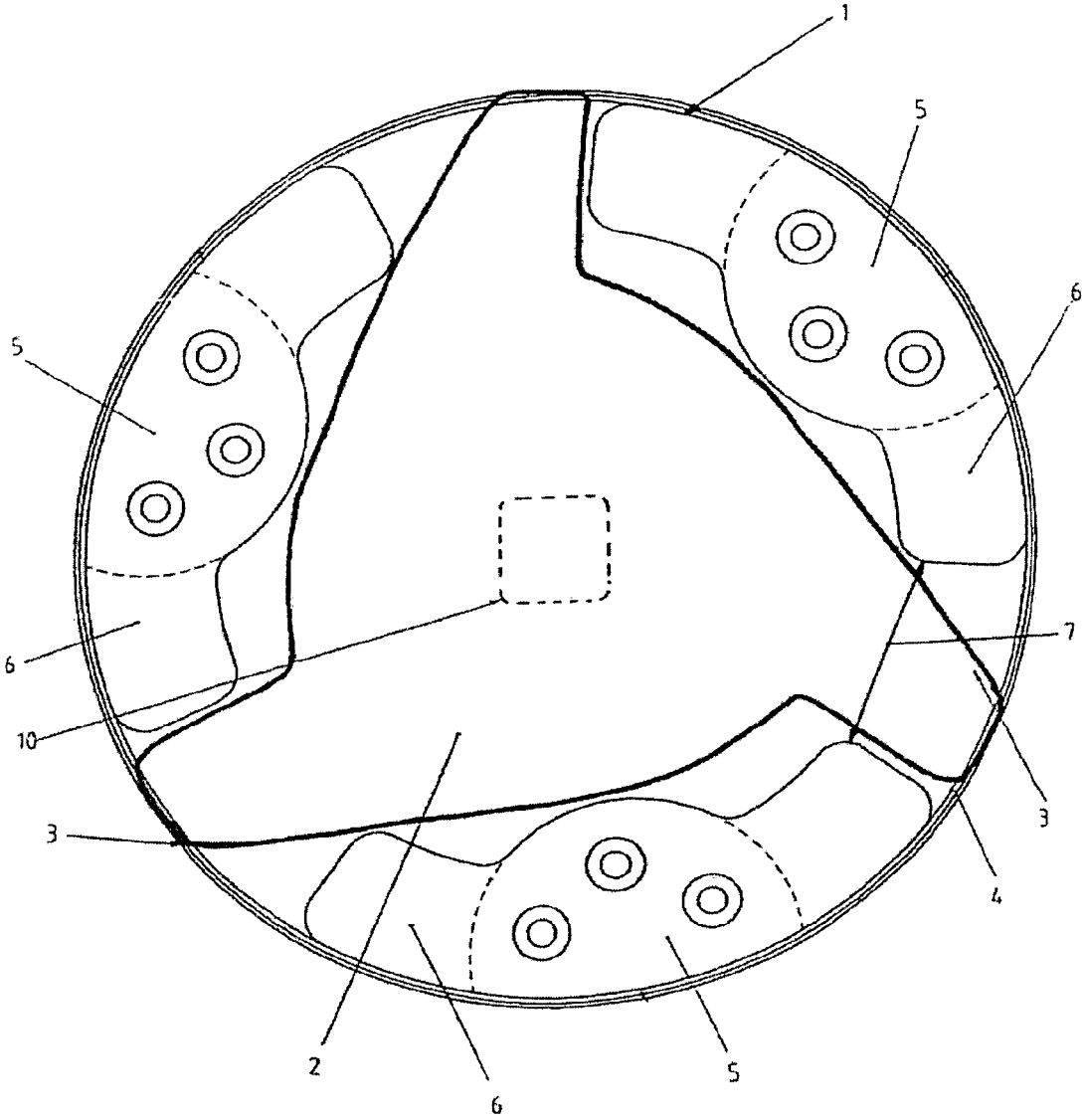
FIG. 1—a top view of a tool according to the invention, with a wing nut inserted therein.
Figure 2:
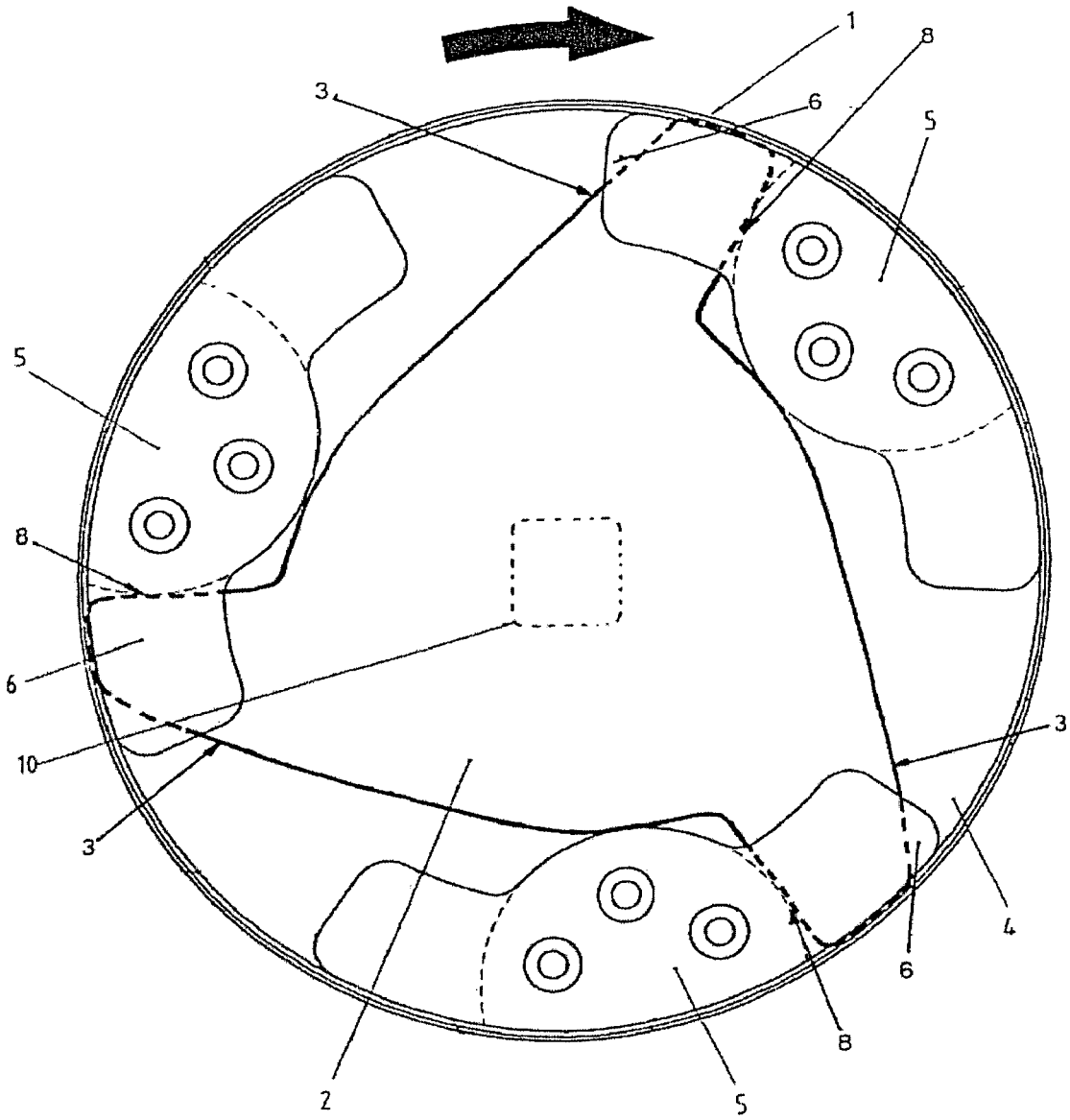
FIG. 2—the tool shown in FIG. 1, in a functional position when the wing nut is being tightened.
Figure 3:
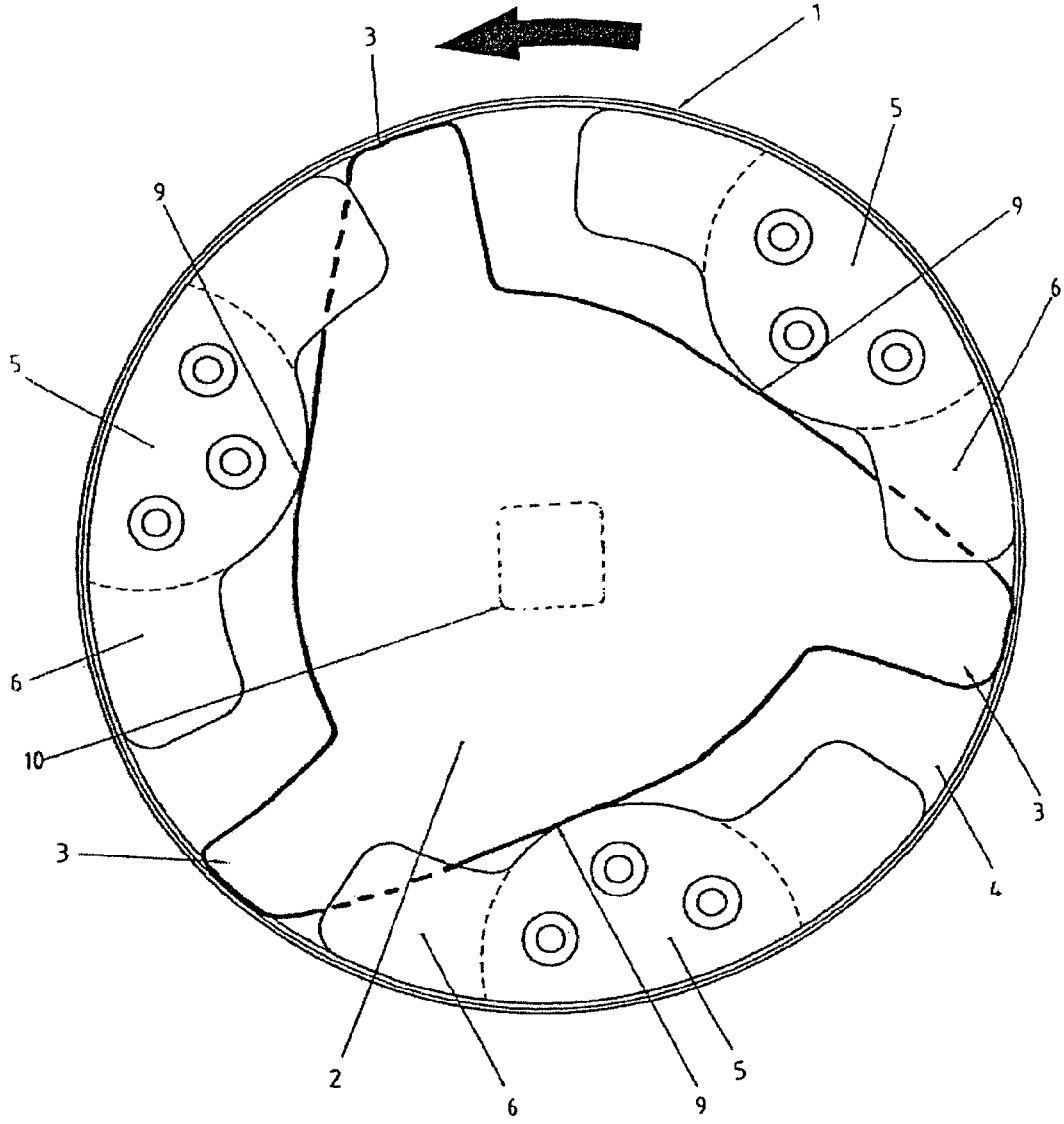
FIG. 3—the tool shown in FIG. 1, in a functional position when the wing nut is being loosened.

FIGS. 1 to 3 each show a top view of a tool 1 for tightening and loosening a wing nut 2 having several wings 3 that secures a motor vehicle wheel. The tool 1 has a base element 4 with three detachably attached contact bodies 5 for the individual wings 3, said bodies serving to transfer the torque needed for tightening and loosening the wing nuts 2. The end of each contact body 5 facing the wheel is provided with a projection 6 that, for purposes of avoiding axial slippage of the tool 1 off the wing nut 2 in the functional position shown in FIGS. 2 and 3, engages behind a wing 3. The projection 6 in question is dimensioned in such a manner that a slot 7 located between adjacent projections 6 is only slightly larger than the corresponding wing 3, as can be seen in FIG. 1. Each of the contact bodies 5, which are configured as cleats, has a contact surface 8, 9 that can be placed against the wing 3 during either tightening or loosening. In order to apply the torque, the base element 4 has a receptacle 10 configured as a square opening to receive a commercially available torque tool.

Figure 4:
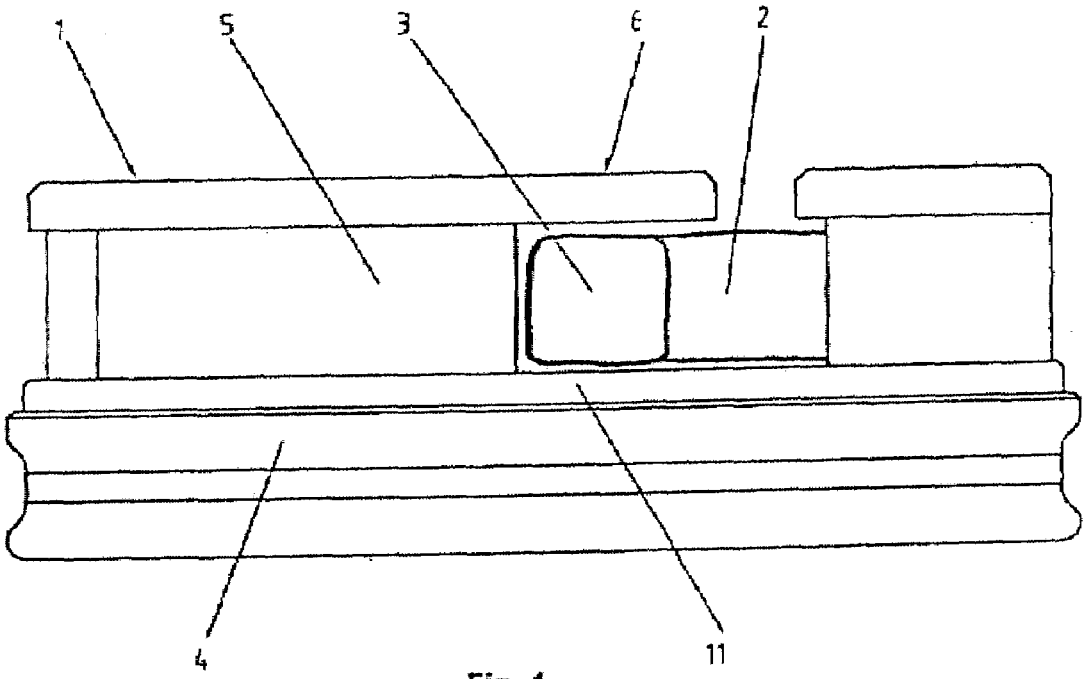
FIG. 4—a side view of the tool in the functional position shown in FIG. 2.

Additionally, FIG. 4 shows the tool 1 depicted in FIG. 2 in a side view in the functional position that serves to tighten the wing nut 2. Here, the projection 6 covers a section of the wing 3, thereby reliably preventing axial slippage of the tool 1. Like the plastic plate 11 located between the base element 4 and the wing nut 2, the contact body 5 that transfers the torque is also made of a material that protects the surface of the wing nut 2.

Figure 5:
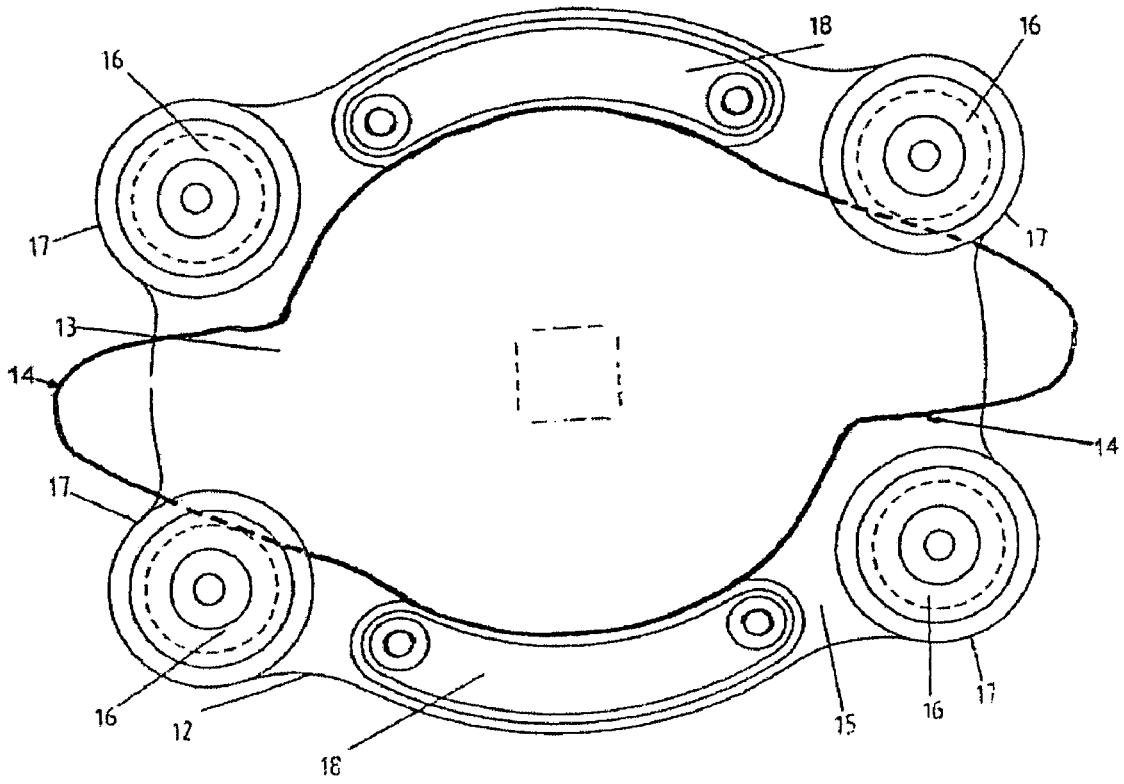
FIG. 5—a top view of another tool according to the invention designed for wing nuts having two wings, in a functional position.

A design of another tool 12—differing from the tool shown in FIGS. 1 to 4—for tightening and loosening a wing nut 13 having two wings 14 is depicted in FIG. 5 in a top view. This figure shows a base element 15 with four contact bodies 16 that, in pairs, each serve to transfer the tightening moment and the loosening moment when the wing nut 13 is tightened or loosened, respectively. The contact body 16, which is rotation-symmetrical here, has a detachably affixed projection 17 which, in the functional position shown, locks the corresponding wing 14. As a result, axial slippage of the tool 12 off the wing nut 13 is reliably ruled out. In order to stabilize the wing nut 13, the tool 12 has two opposing guides 18 that pivot to receive the wing nut 13.

The invention claimed is:

1. A tool for tightening and loosening a central wing nut or wing screw having a plurality of wings, the tool comprising:

a base element;

at least two contact bodies separated by slots and configured to transfer torque from the tool to the wing nut or wing screw in an operating position of the tool; and a projection configured to engage behind at least one of the plurality of wings in the operating position so as to prevent the tool from slipping off the wing nut or wing screw, wherein the projection is configured to leave a portion of each of the slots dimensioned to receive a corresponding one of the plurality of wings, and wherein a relative change of the angular position of the tool causes a locking of the plurality wings in the slots.

2. The tool as recited in claim 1, wherein the wing nut or wing screw secures a wheel of a motor vehicle.

3. The tool as recited in claim 1, wherein the projection is configured as a bayonet coupling.

4. The tool as recited in claim 1, wherein each of the at least two contact bodies has a contact surface that can be placed against each of the corresponding wings during the tightening or loosening of the wing nut or wing screw.

5. The tool as recited in claim 1, wherein each of the at least two contact bodies is configured symmetrically.

6. The tool as recited in claim 1, wherein the tool is configured so that during the tightening or loosening each of the wings can be placed against an adjacent one of the contact bodies.

7. The tool as recited in claim 1, wherein the contact bodies are configured to be replaceable.

8. The tool as recited in claim 1, wherein the contact bodies are configured to be affixed onto the base element in different positions.

9. The tool as recited in claim 1, wherein the contact bodies include at least one of aluminum, copper and plastic.

10. The tool as recited in claim 1, wherein the base element has one or more placement elements for axially stabilizing the wings.

11. The tool as recited in claim 1, wherein the base element has a receptacle configured to receive a commercially available torque tool.

12. The tool as recited in claim 11, wherein the receptacle has a polygonal opening.

13. The tool as recited in claim 1, wherein the wing nut or wing screw includes two wings, and wherein the tool further comprises a pivoting guide configured to receive the two wings so as to stabilize the wing nut or the wing screw.

14. The tool as recited in claim 1, wherein the base element has, at least in sections, a plastic surface configured to avoid damage to the wing nut or wing screw.

15. The tool as recited in claim 14, wherein the plastic surface is formed from a foam plate.

16. A method for tightening a wing nut or wing screw of a motor vehicle having a plurality of wings, the method comprising:

disposing the wings into slots of a base element of the tool as recited in claim 1;

pivoting the base element relative to wing nut or wing screw so that each of the wings comes to rest against contact bodies connected to the base element and so that each of the wings is simultaneously secured by a projection from each of the contact bodies that engages behind the wing in order to prevent the tool from axially slipping off the wing nut or wing screw.

* * * * *